US007397200B2

(12) United States Patent
Adam

(10) Patent No.: US 7,397,200 B2
(45) Date of Patent: Jul. 8, 2008

(54) DEVICE FOR THE CONTROL OF FLUORESCENT LAMPS IN A LIGHTING ARRANGEMENT

(75) Inventor: Juergen Adam, Burgau (DE)

(73) Assignee: Minebea Co., Ltd., Miyota-machi (JP)

( * ) Notice: Subject to any disclaimer, the term of this patent is extended or adjusted under 35 U.S.C. 154(b) by 0 days.

(21) Appl. No.: 11/437,698

(22) Filed: May 22, 2006

(65) Prior Publication Data

US 2006/0273743 A1 Dec. 7, 2006

(30) Foreign Application Priority Data

Jun. 3, 2005 (DE) ..... 10 2005 025 682

(51) Int. Cl.
*H05B 37/02* (2006.01)

(52) U.S. Cl. ..... 315/291; 315/307; 315/308

(58) Field of Classification Search ..... 315/209 R, 315/224, 247, 291, 307, 225, 318, 361
See application file for complete search history.

(56) References Cited

U.S. PATENT DOCUMENTS 4,933,798 A * 6/1990 Widmayer et al. ..... 361/18
5,083,065 A * 1/1992 Sakata et al. ..... 315/307
5,347,198 A * 9/1994 Kimball ..... 315/167
5,521,467 A * 5/1996 Statnic et al. ..... 315/247
5,615,100 A * 3/1997 Radecker et al. ..... 363/97
5,886,477 A * 3/1999 Honbo et al. ..... 315/209 PZ
6,108,215 A 8/2000 Kates et al. ..... 315/307
6,198,234 B1 3/2001 Henry ..... 315/247
6,420,839 B1 7/2002 Chiang et al. ..... 315/291
6,538,373 B2 3/2003 Fujimoto ..... 315/291
6,670,781 B2 12/2003 Weindorf ..... 315/209 R
2003/0160574 A1 * 8/2003 Gray ..... 315/291

* cited by examiner

*Primary Examiner*—Douglas W. Owens
*Assistant Examiner*—Jimmy T Vu
(74) *Attorney, Agent, or Firm*—Dunae Morris LLP

(57) ABSTRACT

The invention relates to a device for the control of fluorescent lamps in a lighting arrangement that comprises at least one such fluorescent lamp, wherein for each fluorescent lamp the device has the following characteristics: a capacitive voltage divider consisting of a first capacitor and a second capacitor that are connected in series to the fluorescent lamp, a switch that is connected in parallel to one of the capacitors, means of measuring the momentary lamp current that flows through the fluorescent lamp and a control circuit to generate an input signal for the semiconductor switch depending on the momentary lamp current.

19 Claims, 3 Drawing Sheets

DEVICE FOR THE CONTROL OF FLUORESCENT LAMPS IN A LIGHTING ARRANGEMENT

CROSS-REFERENCE TO RELATED APPLICATIONS

Figure 1:
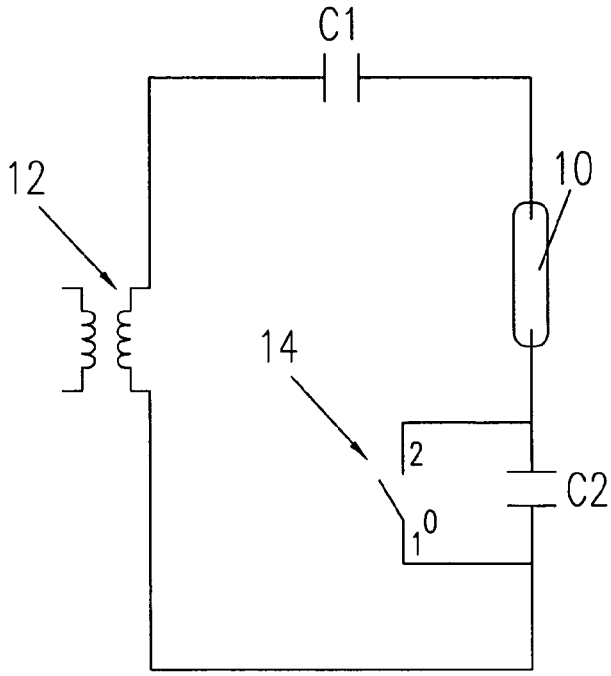

The present application is based upon and claims the benefit of priority under 35 U.S.C. § 119 from German Patent Application 10 2005 025 682.1, filed 3 Jun. 2005, the entire contents of which are hereby incorporated herein by reference.

FIELD OF THE INVENTION

The invention relates to a device for the control of fluorescent lamps in a lighting arrangement that comprises at least one such fluorescent lamp. The fluorescent lamp is particularly a cold cathode fluorescent tube that is used to illuminate displays.

BACKGROUND OF THE INVENTION

Fluorescent lamps are used as a backlight in liquid crystal displays (LCDs), as employed, for example, in computer screens. Similar backlights are also found in other types of displays in a wide range of applications, such as in motor vehicles, illuminated advertising panels and suchlike.

Cold cathode fluorescent tubes are generally employed in backlights for LCD screens. They have the advantage of generating a small amount of heat combined with a relatively long useful life and high efficiency. Moreover, the electrode structures are simple making it possible to produce very small cold cathode fluorescent tubes that can also be used in small liquid crystal displays.

A cold cathode fluorescent tube comprises a tube having a high-voltage terminal at a first end of the tube and a low-voltage terminal at the second end of the tube. The high-voltage terminal is supplied with a high-frequency AC voltage, a typical supply voltage having a frequency of approximately 50 to 100 kHz and a voltage amplitude of approximately 500 to 1000 V. The low-voltage terminal is generally connected to ground. However, it is also possible to connect the two cold cathode fluorescent tube terminals to AC voltages that are offset by 180° with respect to each other (non-inverted and inverted), a virtual ground being located at about the center of the tube. This is especially expedient for particularly long tubes.

A key criterion for LCDs is that they illuminate the entire display surface as uniformly as possible. Depending on the size of the screen, two to 16, or even more, cold cathode fluorescent tubes are used for the backlight. The lamps are arranged parallel to each other, vertically above one another and their light is distributed on a liquid crystal plate via a reflector and via a diffuser plate. To achieve the most uniform distribution of brightness that is possible, it is not only necessary for the individual lamps to glow with the same brightness, but each individual lamp in itself must also emit a uniformly bright light along its length. An uneven distribution of brightness between individual lamps due to manufacturing tolerances may occur and can be kept under control to a certain extent by selection during the manufacturing process.

Cold cathode fluorescent tubes in liquid crystal displays are supplied with a high-frequency AC voltage via an inverter, called a backlight inverter. A reflector directs the light emitted by the lamps onto a diffuser plate which guides and distributes the light onto a liquid crystal plate. The liquid crystal plate is generally inserted between two polarization plates. The entire arrangement is held in a frame. Cold cathode fluorescent tubes have negative incremental resistance. Until the starting voltage is reached, a current having only a very low current intensity flows through the lamp. The intensity of the current then rises rapidly and the voltage drops at the same time. In order to compensate the negative incremental resistance of the fluorescent tube, in the prior art the tube is frequently connected in series with a capacitor with the aim of generating an overall positive incremental resistance and stabilizing the circuit. This series capacitor is also referred to as "ballast" and is chosen to match the resistance of each fluorescent lamp. Due to manufacturing tolerances, the various fluorescent lamps that are connected in parallel in a lighting arrangement have different resistances, with the result that the effective lamp current of the fluorescent lamps vary, thus causing a non-uniform distribution of brightness. This problem is intensified in the situation where the brightness of the fluorescent lamp is reduced by analogue dimming.

U.S. Pat. No. 6,670,781 relates to the control circuit for cold cathode fluorescent tubes for LCDs and deals with the problem that, particularly in the case of analogue dimming, these lamps emit a non-uniform brightness and flicker. To solve this problem, U.S. Pat. No. 6,670,781 proposes a new control method for fluorescent lamps that uses a predetermined number of current pulses.

Other fluorescent lamps and particularly cold cathode fluorescent tubes for liquid crystal displays and associated control devices are described, for example, in U.S. Pat. Nos. 6,538,373 and 6,108,215.

Japanese Patent Application JP 2002 352974 A and the associated Patent Abstract describe a device for the control of cold cathode fluorescent tubes in a lighting arrangement having a plurality of such cold cathode fluorescent tubes, the current flowing through each cold cathode fluorescent tube being controlled. The current flowing through the tubes is measured and entered into a microcomputer via rectifier circuits. The microcomputer generates PWM control signals as a function of the measured tube currents to drive transistors for the control of the tube current. The cold cathode fluorescent tubes are connected in series with resistors that are bridged by the transistors. The series resistors generate additional losses in the circuit arrangement.

It is an object of the invention to provide a lighting arrangement having a plurality of fluorescent lamps, and particularly cold cathode fluorescent tubes, that emit a uniform brightness in both normal operation as well as over a wide dimming range.

SUMMARY OF THE INVENTION

The invention provides a device for the control of the fluorescent lamps of a lighting arrangement that has at least one, preferably several, such fluorescent lamps. For each fluorescent lamp, the controller comprises a capacitive voltage divider consisting of a first and a second capacitor that are connected in series to the fluorescent lamp, a switch that is connected in parallel to one of the capacitors, means of measuring the momentary lamp current that flows through the fluorescent lamp, and a control circuit to generate an input signal for the switch depending on the momentary lamp current. The switch bridges one of the capacitors so that the voltage across the fluorescent lamp can be changed by closing and opening the switch in order to adjust the lamp current in the fluorescent lamp. In a lighting arrangement having a plurality of fluorescent lamps, the switches associated with the respective fluorescent lamps are preferably operated such that the individual lamp currents are identical and the fluorescent lamps thus generate the same brightness. Since a capacitive voltage divider is used, when the switch is open, almost no or only negligible losses are produced via the capacitor. Alongside the energy saving, the low power loss has the advantage that the capacitor itself can be realized in SMD technology by a single, small component. If, on the other hand, an ohmic voltage divider is used, considerable losses would be generated at the resistors which could make it necessary to divide the voltage load over several resistors. The provision of a capacitive voltage divider that is connected in series to the fluorescent lamp has the further advantage that the second capacitor acts as additional "ballast" for the fluorescent tube and makes an added contribution to the stabilization of the characteristic curve of the fluorescent tube. It is expedient if the first capacitor of the capacitive voltage divider corresponds to the capacitor that is connected in series to the fluorescent tube for the purpose of stabilizing the characteristic curve of the fluorescent tube, as is know in the prior art.

The switch is preferably a semiconductor switch and in particular a MOSFET or a bipolar transistor.

The control circuit of the device according to the invention preferably comprises a control amplifier that receives a lamp current actual value and a lamp current target value as input signals and emits a lamp current error signal. This error signal is used to generate the input signal to control the switch in order to regulate the lamp current.

In a particularly preferred embodiment of the invention, the control circuit further comprises a comparator circuit that is connected between the control amplifier and the switch and that, depending on the lamp current error signal of the control amplifier and a periodic ramp signal, generates the input signal for the switch. The periodic ramp signal is preferably the output signal of a burst generator, as is generally known in the prior art. Burst generators are used in the control of fluorescent lamps to dim the lamp. They generate a ramp signal having a burst frequency that is used to switch the supply voltage of the fluorescent lamp on and off. The ratio between the on and off-time determines the dimming level of the fluorescent lamp.

The invention thus makes advantageous use of the ramp signal of the burst generator which is generally available in the control circuits for fluorescent lamps of the prior art, in order to finely regulate the lamp current. Here the comparator, which receives as an input signal the ramp signal of the burst generator as well as the lamp current error signal, generates a PWM signal as an input signal for the switch.

Whereas in control circuits for fluorescent lamps of the prior art, the burst generator is used to dim the lamp such that it switches the supply voltage of the fluorescent lamp on and off at between 0% and 100% of its maximum value, the ramp signal is used according to the invention to control or regulate the lamp current in a range, for example, of 10%, or +/−5% of the supply voltage to ensure that several fluorescent lamps connected in parallel carry the same lamp current and thus generate the same brightness.

In an alternative embodiment of the invention, the control circuit does not comprise a control amplifier but rather only the comparator circuit that receives the lamp current actual value and the ramp signal of the burst generator as input signals and generates the input signal for the switch as a function of these. Although this embodiment can be realized using fewer components than the embodiment having the control amplifier, it is not capable of adjusting the lamp currents as precisely.

Whereas in the first-described embodiment, the lamp currents of several fluorescent lamps connected in parallel are regulated to the extent that they only differ by approximately 1%, it not being possible for the human eye to detect this difference, this precision cannot generally be achieved in the second embodiment. Nevertheless, the second embodiment still manages to improve the uniform brightness of the fluorescent lamps compared to the prior art.

In a preferred embodiment of the invention, a lamp current evaluation circuit is provided that is connected in series to the fluorescent lamp and derives the lamp current actual value. The lamp current evaluation circuit can be constructed in a way generally known in the prior art.

According to the invention, it is further preferable if an overall current evaluation circuit is provided that measures the current that flows through all of the fluorescent lamps and forms a lamp current average value that can be used as the lamp current target value. This means that the lamp current target value can be generated in a particularly simple way, the object of the invention that all the lamps shine with the same brightness being nonetheless achieved.

Control devices for fluorescent lamps generally have a switching stage and a transformer that comprises a primary winding and a secondary winding. In the preferred embodiment of the invention, the overall current evaluation circuit is connected in series to the secondary winding of the transformer and measures the transformer reverse current that flows through the secondary winding. This corresponds precisely enough to the overall current flowing through all the fluorescent lamps.

The capacitive voltage divider of the device according to the invention is preferably arranged such that a first capacitor is connected upstream and a second capacitor downstream from the fluorescent lamp. The first capacitor corresponds to the ballast capacitor which is basically known in the prior art and used to convert the negative characteristic of the fluorescent lamp to a positive characteristic. The switch is preferably connected in parallel to the second capacitor, the capacitance ratio between the first and the second capacitor being, for example, approximately 1:5. The dimensioning thus chosen goes to ensure that an excessive voltage drop does not occur at the second capacitor and the switch so that the second capacitor can be realized by a 400 V-capacitor, for example. The same voltage carrying capacity also applies to the switch, which preferably takes the form of a MOSFET.

The capacitance ratio of the voltage divider further determines the voltage range of the fluorescent lamp, e.g. 10% of maximum voltage, that can be outputted using the invention.

SHORT DESCRIPTION OF DRAWINGS

Figure 2:
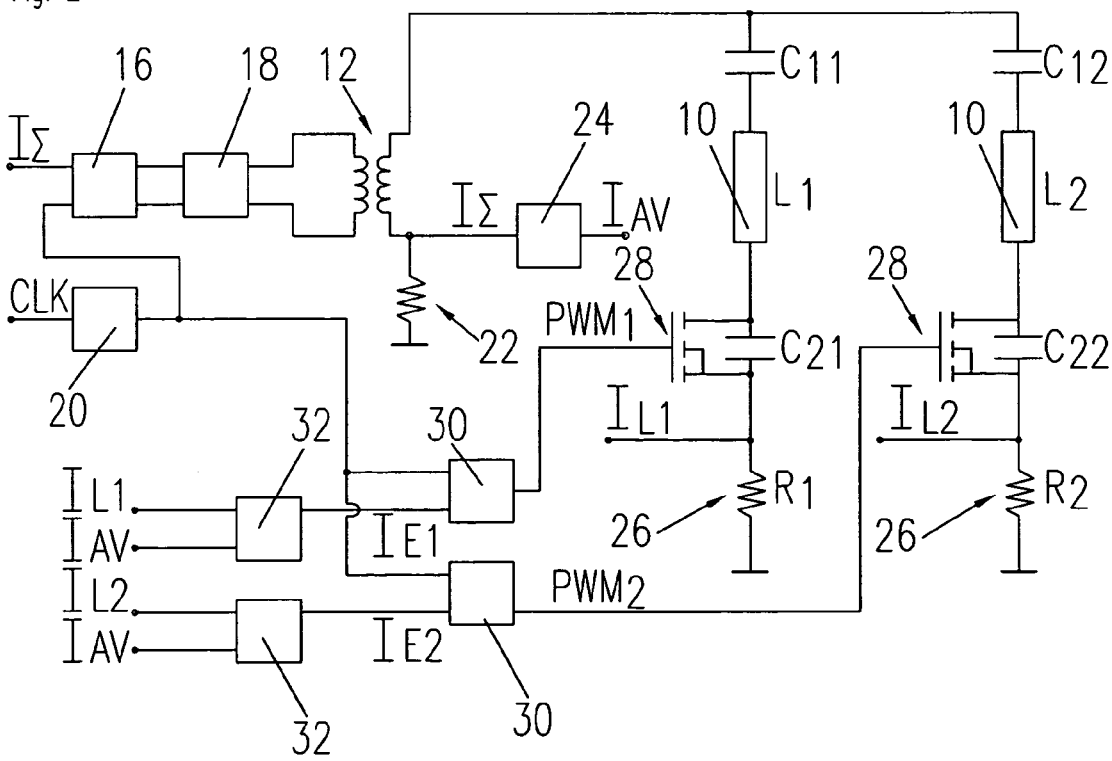
Figure 3:
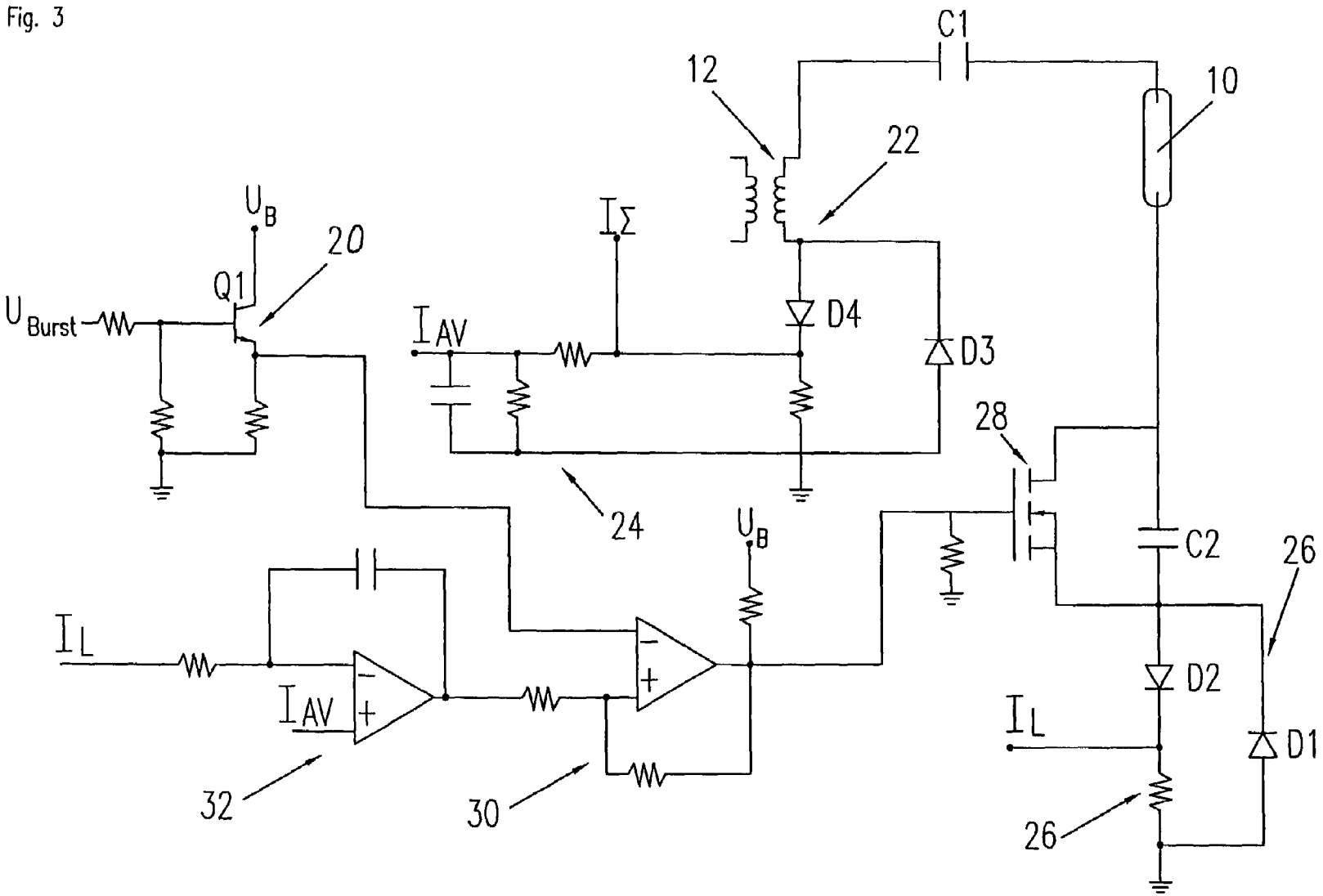
Figure 4:
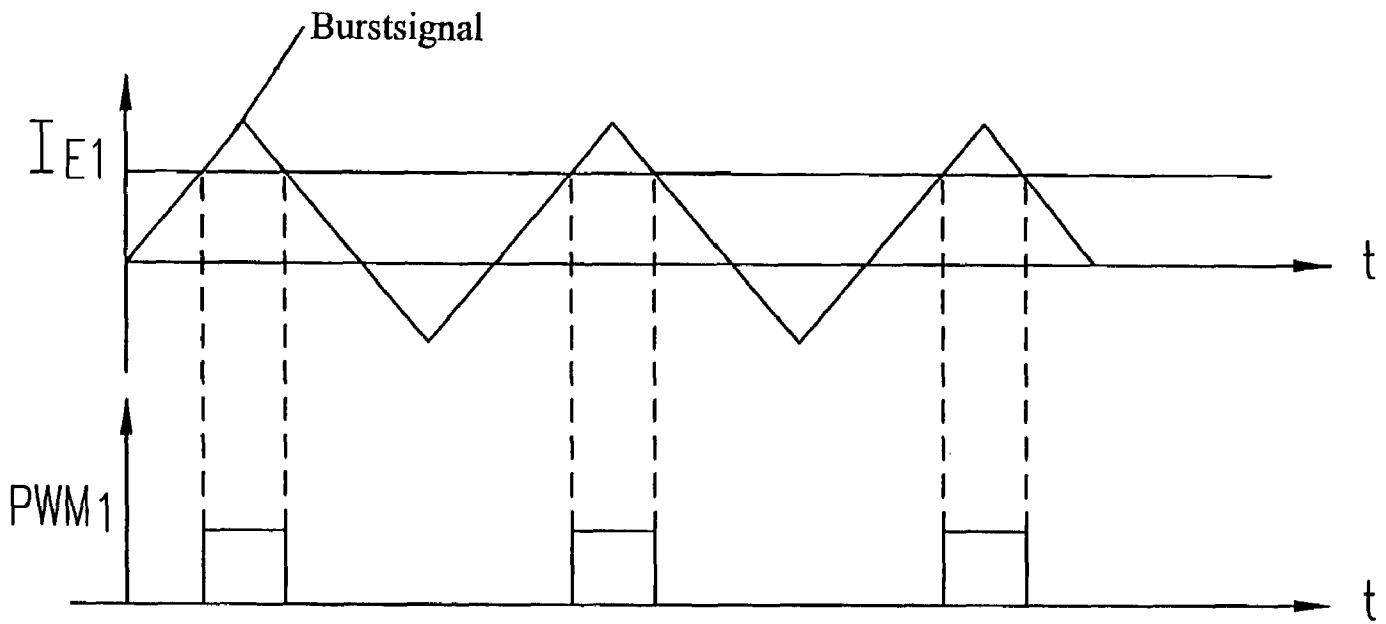

The invention is explained in more detail below on the basis of a preferred embodiment with reference to the drawings. The figures show:

FIG. 1 a circuit to explain the concept on which the invention is based;

FIG. 2 a block diagram of the device for the control of fluorescent lamps in a lighting arrangement according to the invention;

FIG. 3 a detailed circuit diagram of the device according to the invention; and FIG. 4 a time-lapse diagram of signals that occur in the device according to the invention.

DETAILED DESCRIPTION

FIG. 1 shows a circuit diagram to explain the underlying principle of the invention. The circuit comprises a fluorescent lamp 10, particularly a cold cathode fluorescent tube that is fed from a transformer 12 via a capacitive series circuit. The capacitive series circuit comprises two separate capacitors C1, C2 that form a voltage divider. One of these capacitors belonging to the voltage divider is bridged by a switch 14 that is controlled, for example, by pulse width modulation in order to adjust the lamp voltage and thus the lamp current. Linear control of the switch 14 also lies within the range of the invention.

In the case of a lighting arrangement having a plurality of fluorescent lamps 10, only one transformer 12 having an associated switching stage is needed and only the elements on the secondary side, i.e. the capacitors C1, C2 and the switch 14, have to be provided separately for each of the fluorescent lamps. In practice, the circuit further comprises current evaluation and controlling elements for the control of the switch 14.

The invention realizes a particularly simple and cost-effective means of controlling several fluorescent lamps of a lighting arrangement such that the lamp currents of the individual fluorescent lamps are regulated to one and the same target value. Here, the invention makes use of components which are usually found in control circuits for fluorescent lamps of the prior art. The invention can be realized using a few additional, low-cost elements and, in comparison to a control circuit that does not include current control of the individual fluorescent lamps, it has practically no additional losses.

Whereas fluorescent tubes have an absolute lamp current tolerance of approximately 10% due to manufacturing tolerances, such deviations can be reduced to less than 1% by the control system according to the invention, i.e. the deviation can be reduced to a level that is no longer discernible by the human eye.

FIG. 2 shows a simplified block diagram of a preferred embodiment of the device according to the invention.

In FIG. 2, two exemplary fluorescent lamps 10, L1 and L2, are shown that are fed from a transformer 12. The invention can be applied to any number of fluorescent lamps desired, arrangements having up to 16 or 32 lamps being common, yet the invention is not limited to an even or odd number of lamps. The invention can further be used in fluorescent lamps having different lengths, such as in the range of 10 cm to 1 m and more.

The transformer 12 is controlled and supplied via a switching stage, as schematically shown in FIG. 2 by a pulse width modulation circuit 16 and a bridge circuit 18. The circuit further comprises a burst generator 20 that is particularly used to dim the fluorescent lamps 10 and is basically known from the prior art. The output of the burst generator 20 is connected to an input of the pulse width modulation circuit 16, a further input receiving a current sum signal $I_\Sigma$ that is derived from the secondary side of the transformer 12. This current sum signal $I_\Sigma$ corresponds substantially to the overall current flowing through all the fluorescent lamps 10 and is led back to the primary side of the transformer 12 in order to control the transformer as is basically known in the prior art.

The burst generator 20 generates a ramp signal having a burst frequency in the range of approximately 100 to 300 Hz that can be used to switch the supply of the transformer 12, and thus the fluorescent lamps 10, on and off. The ratio between the on and off-time determines the dimming level of the fluorescent lamps. During the on-time, the transformer 12 is driven at an operating frequency in the range of 50 to 100 KHz, while during the off-time, the control signal to the transformer 12 is completely blocked. As a result, the fluorescent lamps may be dimmed in a range of 0% to 100%.

On the secondary side of the transformer 12, an overall current evaluation circuit 22 is schematically shown by a resistor via which the overall current, or the current sum signal $I_\Sigma$, is measured. This signal is applied to an averaging circuit 24 in order to produce a current average value $I_{AV}$ which is used as the lamp current target value for the individual fluorescent lamps 10, as is explained in more detail below. The averaging circuit 24 divides the current sum signal by the number of fluorescent lamps 10 in the lighting arrangement in order to ascertain the current average value $I_{AV}$ that is to flow through all the fluorescent lamps 10. This is a particularly simple method of generating a target value for regulating the current through the individual fluorescent lamps 10.

Two fluorescent lamps 10 and their associated control circuits are shown in FIG. 2. The first fluorescent lamp L1 is connected in series between a first capacitor C11 and a second capacitor C21, and the second fluorescent lamp L2 is connected in series between a first capacitor C12 and a second capacitor C22. A lamp current evaluation circuit 26 for the first fluorescent lamp L1 is shown schematically by the resistor R1, and a lamp current evaluation circuit 26 for the second fluorescent lamp L2 is shown schematically by a resistor R2. Since the control circuits for the fluorescent lamps L1 and L2 are identical in design, only the control circuit for the fluorescent lamp L1 is described below, the same description applying to the control circuit of the fluorescent lamp L2.

The fluorescent lamp 10 is connected in series between the capacitors C11 and C21 that form a capacitive voltage divider, the second capacitor C21 being bridged by a switch 28. In the illustrated embodiment, the switch 28 is a MOS FET, however it may be realized using any other semiconductor switch, such as a bipolar transistor, or by using other types of switches. As explained in reference to FIG. 1, the switch 28 is controlled in order to adjust the voltage across the fluorescent lamp 10, and thus the lamp current $I_{L1}$, allowing the brightness of the fluorescent lamp to be regulated. The lamp current actual value $I_{L1}$ is measured via the resistor R1.

The switch 28 can be controlled either linearly or discretely, preferably using pulse width modulation, a preferred embodiment of the invention to generate the control signal being described below.

In practice, the starting voltage of the fluorescent lamp 10 is approximately 1000 V effective, and the capacitance ratio between the capacitors C11 and C21 lies in the magnitude of 1:5. If, for example, the value of capacitor C11 is 22 pF and the value of capacitor C21 is 100 pF, then capacitor C21 has to be dimensioned such that it can withstand an effective voltage average value of 220 V and a voltage peak value of 311 V. In practice, a capacitor having a voltage carrying capacity of approximately 400 V can be used for this purpose.

The described capacitance ratio of the voltage divider of 1:5 makes it possible to compensate an absolute lamp current tolerance of 10%, or +/−5%. Care must be taken here to ensure that the control circuit according to the invention is actually constructed in the simplest possible way; in the preferred embodiment, the control circuit is designed in such a way that the capacitor C21 and the switch 28 only have influence on a half-wave of the lamp voltage.

A comparator 30 and an error amplifier 32 are provided to control the switch 28. The error amplifier 32 may take the form of a PID control element whose proportional (P), integrating (I) and differentiating (D) part can be adjusted according to requirements. The error amplifier 32 receives as input signals the current average value $I_{AV}$, which forms the lamp current target value, as well as the actual lamp current $I_{L1}$ or $I_{L2}$, and generates a current error signal $I_{E1}$, $I_{E2}$ that is used to control the switch 28. In the preferred embodiment, the current error signal $I_{E1}$ or $I_{E2}$ is fed to an input of the comparator 30 whose other input receives the output signal of the burst generator 20. As explained above, the output signal of the burst generator 20 is a periodic ramp signal having a predetermined burst frequency in the range of 100 to several hundred Hz and is used by systems of the prior art to dim fluorescent lamps. In the preferred embodiment of the invention, the comparator 30 compares the ramp signal of the burst generator 20 with the current error signal $I_{E1}$ or $I_{E2}$ and derives a pulse width modulation signal $PWM_1$ or $PWM_2$ to control the switch 28.

FIG. 4 shows a time-lapse diagram to explain the generation of the pulse width modulation signals $PWM_1$ or $PWM_2$. The periodic ramp signal referred to as a burst signal corresponds to the output signal of the burst generator 20. This signal is compared in the comparator 30 with the current error signal $I_{E1}$ or $I_{E2}$ in order, as shown in FIG. 4, to derive the pulse width modulation signal $PWM_1$ or $PWM_2$. The switch 28 is so controlled in this way that the lamp current $I_{L1}$ or $I_{L2}$ follows its target value, it being possible to compensate current deviations of up to 10% in the preferred embodiment of the invention.

FIG. 3 shows a circuit diagram for a practical embodiment of a circuit for the control of a fluorescent lamp according to the invention. Components corresponding to those in FIG. 1 or 2 are indicated by the same reference numbers. In the illustration in FIG. 3, only one channel of the lighting arrangement having a fluorescent lamp 10 is shown, the person skilled in the art being aware that an almost indefinite number of other channels could be added. The transformer 12 forms a common transformer for all the control circuits of the fluorescent lamps 10, it also being within the range of the invention to employ several transformers should this be required by the respective application. The transformer 12 is supplied via a switching stage that has already been explained with reference to FIG. 2. This switching stage can be controlled by an integrated control component, which is basically known and which also comprises the burst generator 20 (FIG. 2). As explained above, with the aid of the burst generator 20, the fluorescent lamp can be dimmed by switching the supply voltage on and off. The periodic ramp signal of the burst generator 20 can further be used for the discretely constructed pulse modulators of each channel of the lighting arrangement according to the invention. To this effect, a transistor Q1 buffers the ramp voltage $U_{Burst}$ of the burst generator and sends it out to the comparator 30.

The comparator 30 can, for example, be realized by a standard comparator model LM339 made by National Semiconductor, California, USA.

The error amplifier 32 is realized by an operational amplifier, such as model LM324 from National Semiconductor and in the illustrated embodiment takes the form of an I-element. As input signals, it receives the lamp current $I_L$ and the current average value $I_{AV}$ and sends out the current error signal as described above.

The switch 28 is designed so that it only switches during the positive half-wave of the burst signal, as shown in FIG. 4, the negative half-wave being suppressed by the internal body diode of the MOSFET switch 28. If, for example, instead of a MOSFET switch, a bipolar transistor switch is used, an extra diode to process the negative half-wave is needed. The lamp current evaluation circuit 26 in the illustrated embodiment also only operates on the basis of the positive half-wave, the negative half-wave being led off by a diode D1. The same applies to the overall current evaluation circuit 22 for measuring the current sum signal $I_\Sigma$ that is connected to the secondary winding of the transformer 12.

An embodiment of the averaging circuit 24 is illustrated in FIG. 3 only by way of example.

The use of a capacitive voltage divider C1, C2 to control the lamp current has the advantage that almost no power loss occurs at the second capacitor C2 when the switch 28 is open. The capacitor C2 further contributes to the ballast capacitor C1 and thus plays a part in stabilizing the characteristic of the fluorescent lamp 10, as mentioned above.

Moreover, in comparison to an arrangement having an ohmic voltage divider, the required transformer voltage that has to be generated via the lamp 10 is somewhat lower.

The invention creates a device for the control of fluorescent lamps in a lighting arrangement which achieves very precise control of all lamp currents to an average value but can nevertheless be realized at low-cost. For each channel, i.e. for each fluorescent lamp, in addition to what is usually found in a control circuit according to the prior art, only an operational amplifier, the error amplifier, and a comparator as well as a MOSFET or a bipolar transistor and a capacitor are needed. The switching of the semiconductor switch 28 can be synchronized with the burst frequency of the burst generator, so that no additional ramp generator to generate the pulse width modulation is necessary and no interferences occur in operation since the transformer 20 is also driven on the basis of the ramp of the burst generator.

The secondary current of the transformer can be used both to control the transformer performance as well as to derive a current average value which is used for active current regulation of the individual channels.

The invention can be applied to a lighting arrangement having any number of fluorescent lamps desired, such as 4, 16 or 32, it being also possible to control uneven numbers of lamps without any problem.

Current regulation to a target value with an accuracy of +/−1% can be achieved, such deviations not being discernible by the human eye.

The features disclosed in the above description, the claims and the figures can be important for the realization of the invention in its various embodiments both individually and in any combination whatsoever.

IDENTIFICATION REFERENCE LIST

10 Fluorescent lamp
12 Transformer
14 Switch
16 Pulse width modulation circuit
18 Bridge circuit
20 Burst generator
22 Overall current evaluation circuit
24 Averaging circuit
26 Lamp current evaluation circuit
28 Switch
30 Comparator
32 Error amplifier
C1, C2 Capacitors
L1, L2 Fluorescent lamps
C11, C21, C12, C22 Capacitors
R1, R2 Resistors
D1, D2, D3, D4 Diodes
$I_L$, $I_{L1}$, $I_{L2}$ Lamp current
$I_\Sigma$ Current sum signal
$I_{AV}$ Current average value
$I_{E1}$, $I_{E2}$ Current error signal
$PWM_1$, $PWM_2$ Pulse width modulation signal
$U_{Burst}$ Ramp voltage of the burst generator

The invention claimed is:

1. A device for the control of fluorescent lamps in a lighting arrangement that comprises at least one such fluorescent lamp, wherein for each fluorescent lamp the device has the following characteristics:

a capacitive voltage divider consisting of a first capacitor and a second capacitor that are connected in series to the fluorescent lamp;

a switch that is connected in parallel to one of the capacitors;

means of measuring the momentary lamp current that flows though the fluorescent lamp; and a control circuit to generate an input signal for the switch depending on the momentary lamp current, wherein the control circuit comprises a control amplifier that receives a lamp current actual value and a lamp current target value as input signals and emits a lamp current error signal.

2. The device according to claim 1, wherein the switch is a semiconductor switch.

3. The device according to claim 2, wherein the switch comprises a MOS FET or a bipolar transistor.

4. The device according to claim 1, wherein the control circuit comprises a comparator circuit that is connected between the control amplifier and the switch and that, depending on the lamp current error signal of the control amplifier and a periodic ramp signal, generates the input signal for the switch.

5. The device according to claim 4, further comprising:

a burst generator that generates the periodic ramp signal.

6. The device according to claim 5, further comprising:

a switching stage for the control of the lighting arrangement, the burst signal having a burst frequency which is two to three magnitudes smaller than a clock frequency of the switching stage.

7. The device according to one of the claim 4, wherein the comparator circuit generates a PWM signal.

8. The device according to claim 1, further comprising:

a lamp current evaluation circuit that is connected in series with the fluorescent lamp and generates the lamp current actual value.

9. A device for the control of fluorescent lamps in a lighting arrangement that comprises at least one such fluorescent lamp, wherein for each fluorescent lamp the device has the following characteristics:

a capacitive voltage divider consisting of a first capacitor and a second capacitor that are connected in series to the fluorescent lamp;

a switch that is connected in parallel to one of the capacitors;

means of measuring the momentary lamp current that flows through the fluorescent lamp; and a control circuit to generate an input signal for the switch depending on the momentary lamp current, wherein the control circuit comprises a comparator circuit that receives an actual lamp current signal and a periodic ramp signal and, depending on these, generates an input signal for the switch.

10. The device according to claim 9, further comprising:

a burst generator that generates the periodic ramp signal.

11. The device according to claim 10, further comprising:

a switching stage for the control of the lighting arrangement, the burst signal having a burst frequency which is two to three magnitudes smaller than a clock frequency of the switching stage.

12. The device according to one of the claim 9, wherein the comparator circuit generates a PWM signal.

13. A device for the control of fluorescent lamps in a lighting arrangement that comprises at least one such fluorescent lamp, wherein for each fluorescent lamp the device has the following characteristics:

a capacitive voltage divider consisting of a first capacitor and a second capacitor that are connected in series to the fluorescent lamp;

a switch that is connected in parallel to one of the capacitors;

means of measuring the momentary lamp current that flows through the fluorescent lamp; and a control circuit to generate an input signal for the switch depending on the momentary lamp current, wherein an overall current evaluation circuit which measures the current flowing though all the fluorescent lamps and forms a lamp current average value wherein the lamp current average value can be used as the lamp current target value.

14. The device according to claim 13, further comprising:

a transformer for the control of the lighting arrangement that has a primary winding and a secondary winding, wherein the overall current evaluation circuit is connected in series with the secondary winding of the transformer.

15. A device for the control of fluorescent lamps in a lighting arrangement that comprises at least one such fluorescent lamp, wherein for each fluorescent lamp the device has the following characteristics:

a capacitive voltage divider consisting of a first capacitor and a second capacitor that are connected in series to the fluorescent lamp;

a switch that is connected in parallel to one of the capacitors;

means of measuring the momentary lamp current that flows through the fluorescent lamp; and a control circuit to generate an input signal for the switch depending on the momentary lamp current, wherein the first capacitor is connected upstream and the second capacitor is connected downstream of the fluorescent lamp.

16. The device according to claim 15, wherein the switch is connected in parallel to the second capacitor.

17. The device according to claim 16, wherein the capacitance ratio between the first capacitor and the second capacitor is approximately 1:5.

18. A control device for an arrangement of fluorescent lamps including at least one fluorescent lamp, the control device comprising:

a capacitive voltage divider including a first capacitor and a second capacitor connected in series to the lamp;

a switch connected in parallel to one of the first and second capacitors;

a current evaluation circuit configured to measure a momentary lamp current through the lamp;

a burst generator configured to generate a periodic ramp signal; and a control circuit configured to generate an input signal for the switch in accordance with the measured momentary lamp current.

19. The control device of claim 18, wherein the control circuit comprises:

a control amplifier configured to output a current error signal in accordance with a current actual value and a current target value; and a comparator circuit disposed between the control amplifier and the switch, the comparator circuit being configured to generate the input signal for the switch in accordance with the current error signal and the periodic ramp signal.

* * * * *